US005558024A

United States Patent [19]

Solera et al.

[11] Patent Number: 5,558,024

[45] Date of Patent: Sep. 24, 1996

[54] BODY ROLL CONTROL SYSTEM FOR A RAILWAY VEHICLE WITH VARIABLE TRIM BODY

[75] Inventors: Leonardo Solera, Seregno; Alberto Magnani; Pier L. Bernabo' Silorata, both of Turin, all of Italy

[73] Assignee: Fiat Ferroviaria Spa, Italy

[21] Appl. No.: 519,145

[22] Filed: Aug. 24, 1995

[30] Foreign Application Priority Data

Apr. 7, 1995 [IT] Italy ..... TO95A0275

[51] Int. Cl.[6] ..... B61F 5/00

[52] U.S. Cl. ..... 105/199.2

[58] Field of Search ..... 105/199.1, 199.2

[56] References Cited

U.S. PATENT DOCUMENTS

| | | | |
|---|---|---|---|
| 2,161,687 | 6/1939 | Schoepf et al. | 105/199.2 |
| 3,286,655 | 11/1966 | Lich | 105/199.2 |
| 4,665,835 | 5/1987 | Mohacsi et al. | 105/199.2 |
| 5,295,443 | 3/1994 | Bangtsson et al. | 105/199.2 |
| 5,454,329 | 10/1995 | Liprandi et al. | 105/199.2 |

*Primary Examiner*—Mark T. Le

*Attorney, Agent, or Firm*—D. Peter Hochberg; Mark Kusner; Michael Jaffe

[57] ABSTRACT

A body roll control system in a railway vehicle with a variable trim body, wherein two pairs of fluid pressure linear actuators are substantially vertically interposed between the body and the opposite sides of two bogies. The control system comprises a single valve unit in common to both actuator pairs, and the actuator of the two pairs placed in correspondence of one side and, respectively, of the other side of the body are connected to each other and with the valve unit through respective common fluid lines.

2 Claims, 2 Drawing Sheets

BODY ROLL CONTROL SYSTEM FOR A RAILWAY VEHICLE WITH VARIABLE TRIM BODY

BACKGROUND OF THE INVENTION

1. Field of the Invention

The present invention is generally related to railway vehicles having a variable trim body, i.e. adapted to be rotated about its longitudinal axis when the vehicle is running along curved paths of the railway track, towards the inside of the curve. These rotations or rolls of the body enable, particularly in the case of high-speed railway vehicles, to appreciably enhance comfort for the passengers, due to the fact that the transverse acceleration felt inside the body while the vehicle is running along a curve is relatively limited.

2. Description of the Prior Art

The body tilt variations are traditionally servo-operated by means of a body roll control system.

U.S. Pat. No. 3,844,225 assigned to Fiat Spa discloses such a control system for a railway vehicle including two bogies and resilient suspension means between the body and the bogies. This control system comprises two pairs of fluid pressure linear actuators substantially vertically interposed between the body and the opposite sides of the two bogies, a source of fluid under pressure, valve means for controlling communication between said actuator means and said source of fluid under pressure through respective fluid lines, a regulation electronic unit operatively associated to said valve means, and transducer means for detecting the non-compensated centrifugal accelerating acting on the vehicle body and for transmitting corresponding output signals to said regulation electronic unit to pilot said valve means, so as to perform, while the vehicle is running along a curve, rotations of the body about a longitudinal axis tending to compensate said centrifugal acceleration.

In conventional control system of the above-referenced type the fluid circuits of the actuator pairs associated to the two bogies of the vehicle are distinct and separate from each other, i.e. in practice independent relative to each other, two respective autonomous solenoid-valve assemblies being provided, which are piloted by the regulation electronic unit following processing of the output signals supplied by the transducer means.

When the vehicle is travelling along a straight path, the two solenoid-valve assemblies keep the actuator of the one and of the other pair isolated. Whenever the vehicle enters the parabolic entry transition section of a curve, the following problem is to be faced.

Upon encountering a track skew, i.e. of the slanting in vertical projection of the outside rail relative to the inside rail in correspondence of the entry transition section of the curve superelevation, the front bogie, with reference to the travel direction, rolls in the vertical plane and transmits to the body a rotation couple, through the corresponding secondary suspension. In such a condition, the suspension located in correspondence of the bogie side which is raised owing to the track skew is contracted, while the suspension located in correspondence of the opposite side tends to be unloaded. In the area of the front bogie a counteracting couple is thus produced, which generates an opposite reaction couple onto the rear bogie, through the corresponding secondary suspension. Therefore, the skew in the entry curve transition section normally produces an unbalanced load distribution over the secondary suspensions of the two bogies, and thus an uneven "unloading" effect of the respective axles.

Simultaneously, while the vehicle is entering the entry curve transition section, actuation of the body roll control system is started by means of the output signals generated by the transducer means, i.e. the actuators of the two bogies are operated. Since as pointed out the two fluid circuits of these actuators according to the prior art are independent from each other, owing to hydraulic or control differences or other kinds of variations or non-symmetries, the couples correspondingly applied by the actuators over the two bogies will normally be different. These different couples differently load the bogie axles, and consequently one axle (and thus the corresponding wheel-rail contacts) may be excessively unloaded. In practice, this situation corresponds to the self-generation by the vehicle itself of an additional skew which actually does not exist, i.e. of an "autogenous skew", which makes the above described situation, deriving from the real presence of a track skew in the entry curve transition section, remarkably worse.

This situation, which negatively affects the actuating condition of the control system also when the vehicle is running along a full curve as well as along the exit curve transition section, after all reduces travel intrinsic safety of the vehicle during operation of the body roll control system.

SUMMARY OF THE INVENTION

The object of the present invention is to overcome the above drawback, and more particularly to prevent generation of "autogenous skew" and related negative effects of further unloading of the vehicle axles in the above-disclosed conditions.

According to the invention, this object is achieved by virtue of a body roll control system in a variable trim body railway vehicle of the type set forth at the beginning, which is essentially characterized in that said valve means comprise a single valve unit in common to said two actuator pairs, and in that the actuators of the two pairs arranged in correspondence of one side and, respectively, of the other side of the body are connected to each other and with said valve unit through respective common fluid lines.

Due to this idea of solution, the actuators of each side of the vehicle are maintained under isobaric connection with each other, which allows, in the actuating condition of the body roll control system, preventing phenomena of "autogenous skew" generation, thus obtaining a higher intrinsic safety degree whenever the vehicle is running along a curved path.

Moreover, the isobaric connection of the actuators makes the body roll control system substantially less rigid with respect to traditional control systems.

BRIEF DESCRIPTION OF THE DRAWINGS

Further features and advantages of the invention will become apparent from the following detailed description with reference to the accompanying drawings purely provided by way of non-limiting example, in which.

DESCRIPTION OF THE PREFERRED EMBODIMENT

Figure 1:
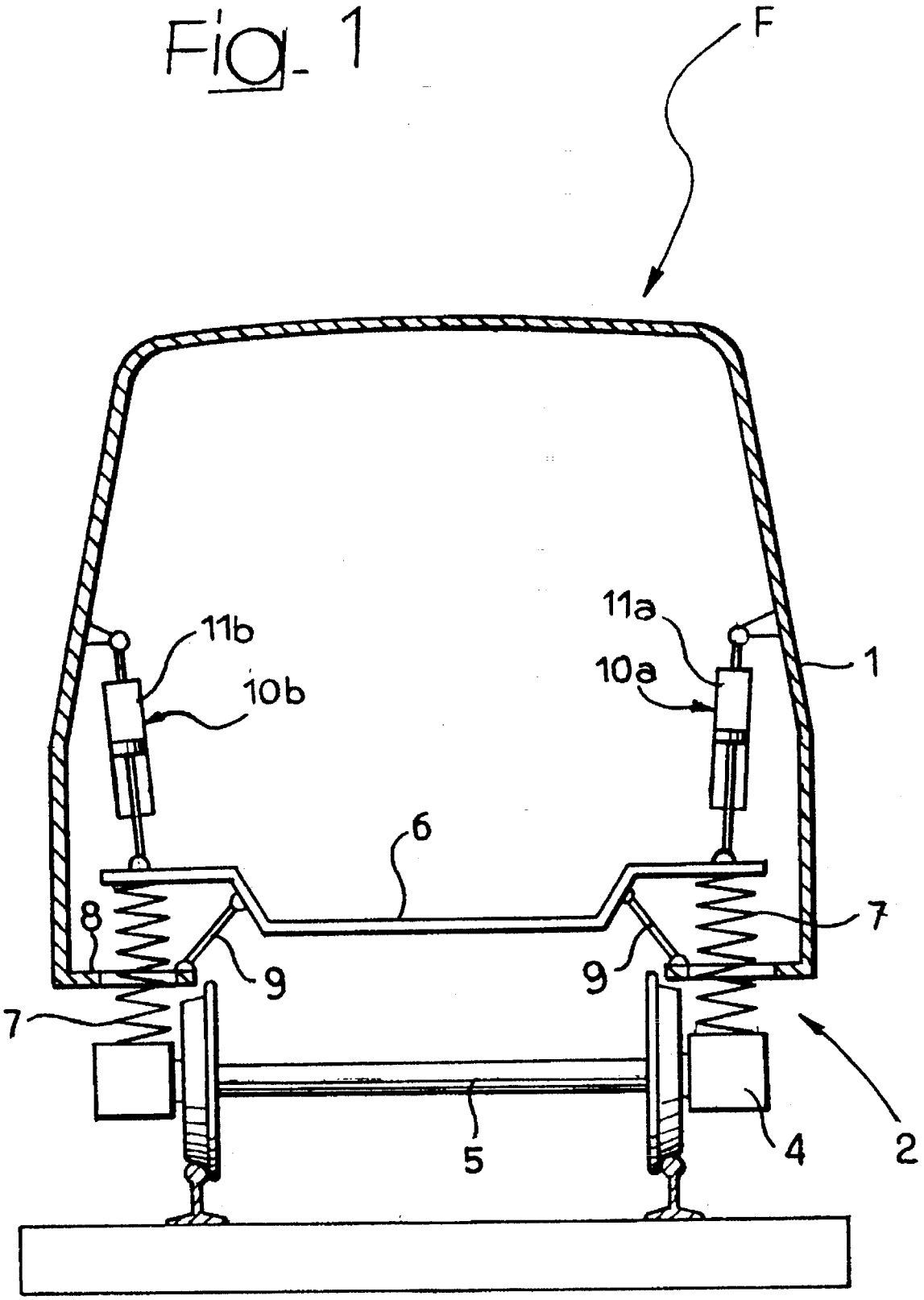
FIG. 1 is diagrammatic and simplified vertical cross section in correspondence of one bogie of a variable trim body railway vehicle equipped with a body roll control system according to the invention.
Figure 2:
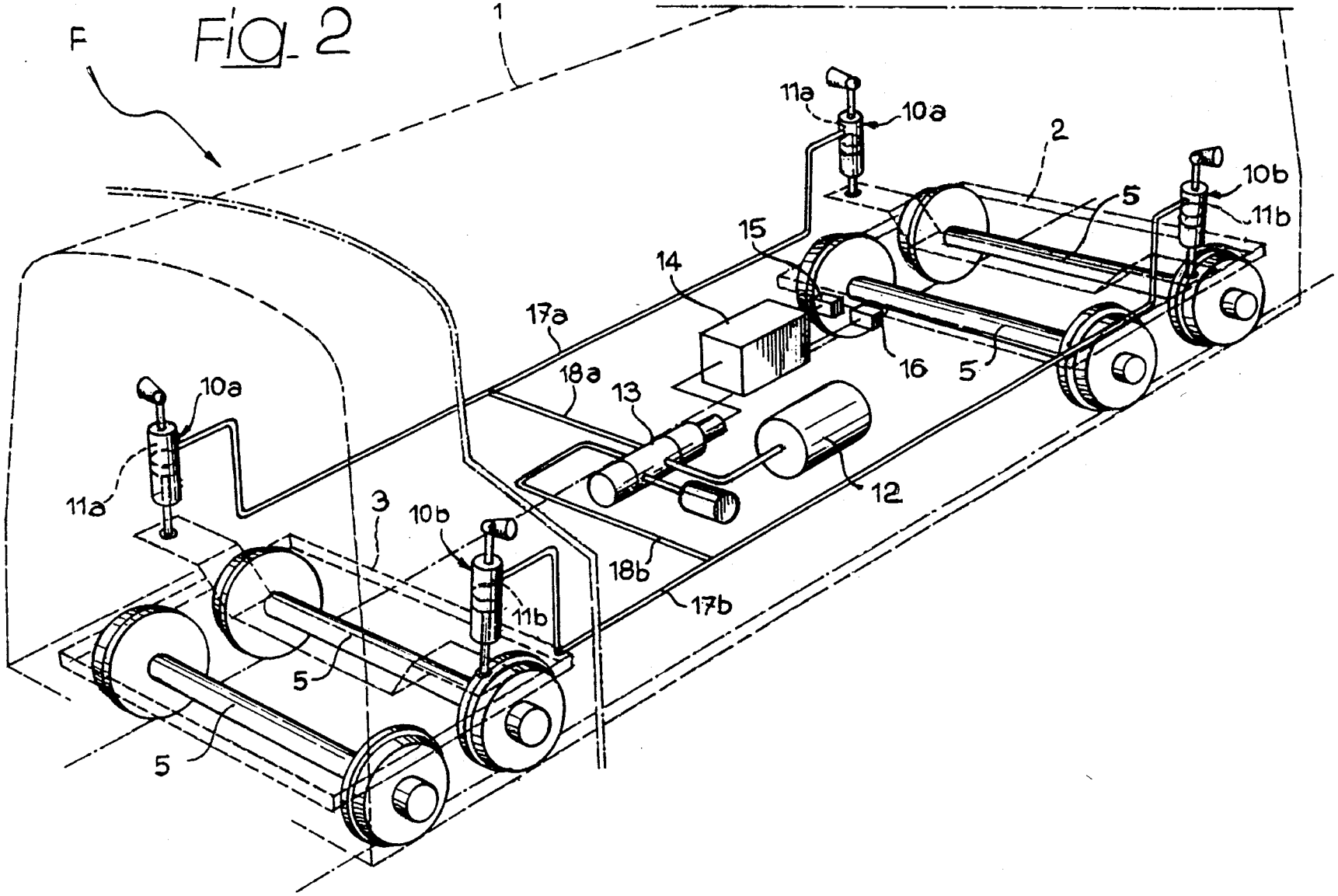
FIG. 2 is a diagrammatic perspective view from above of the control system of the vehicle shown in FIG. 1.

Referring to FIGS. 1 and 2, a railway vehicle F essentially comprises a body 1 supported in proximity of its opposite ends by two bogies 2, 3 each including, in a way known per se, a framework 4, two wheel and axle sets 5 and a swinging transverse member 6. The swinging transverse members 6 are mounted over the bogies 2, 3 substantially in correspondence of the transverse center line thereof, each one with the interposition of vertical helical springs 7 constituting the vertical and lateral secondary suspension of the vehicle.

The body 1 of the vehicle F is connected, also in a way known per se, onto the swinging transverse members 6. Connection between each swinging transverse member and a respective transverse load bearing beam 8 rigidly fixed under the floor of the body 1 is performed, also in a way known per se, through a pair of swing hangers 9.

It is pointed out that the representation of FIG. 1 is to be purely considered as a functional diagram of principle, without a real correspondence with the actual structural construction of the illustrated components.

Between each swinging transverse member 6 and the lateral sides of the body 1 two respective fluid pressure linear actuators 10*a*, 10*b* are arranged, for instance constituted by hydraulic jacks. In alternative, the jacks might also be of pneumatic type.

The arrangement depicted in the drawings is purely diagrammatic even as far as arrangement of the jacks 10*a*, 10*b* is concerned: as a matter of fact in the actual construction of the vehicle these jacks are as a rule interposed between the corresponding ends of the swinging transverse members 6 and of the load bearing beams 8 fixed to the floor of the body 1.

The cylinder upper sides of the two hydraulic jacks 10*a*, 10*b* pairs define respective thrust chambers 11*a*, 11*b* connected, in the way clarified herebelow, to an electro-hydraulic roll control system of the body 1 about a longitudinal axis, so as to vary trim thereof when the vehicle F is travelling along a curved path. The rotation of the body 1 about its longitudinal axis along a curve enables, in a way known per se, compensating the centrifugal force acting on the passengers by means of the lateral component of weight, so that the passengers are affected, even in case of high speed travel, by a relatively limited transverse acceleration.

The body roll control system comprises, also in a way generally known per se, a source of hydraulic fluid under pressure or power generator 12 which is adapted to be connected with the thrust chambers 11*a*, 11*b* of the hydraulic jacks 10*a*, 10*b* via a single solenoid-valve unit 13, in common to both pairs of actuators 10*a*, 10*b*. The solenoid-valve unit 13, which may be constituted by a pressure or flow control valve, is piloted by a regulation electronic unit 14, also of a generally conventional type, which in turn is operatively connected to transducers 15, 16 provided for detecting the condition of vehicle travel along a curved path and the non-compensated centrifugal acceleration acting on the body 1 over a curve, respectively, and for transmitting corresponding output signals to the regulation electronic unit 14 to pilot the solenoid-valve unit 13. The transducers 15 and 16 may traditionally include, for instance, a gyroscope and one or more accelerometers.

In accordance with one fundamental feature of the invention, the thrust chambers 11*a* of the two jacks 10*a* corresponding to one lateral side of the vehicle are connected to each other through a respective common duct 17*a*, and the thrust chambers 11*b* of the two jacks 10*b* corresponding to the other lateral side of the vehicle are connected to each other through a respective common duct 17*b*, and the ducts 17*a*, 17*b* are in turn connected to the valve unit 13 via respective fluid lines 18*a*, 18*b*.

Due to the above-disclosed arrangement of the roll control system of the body 1, the actuators 10*a* and 10*b* corresponding to one and, respectively, to the other vehicle side are maintained under isobaric condition. When the vehicle is travelling along a straight track, which corresponds to the situation shown in FIG. 1 and in which the lines 18*a*, 18*b* are both intercepted by the valve unit 13, this results into a lower rigidity of the connection between the swinging transverse members 16 and the body 1 through the respective actuators, as compared with the conventional body roll control systems wherein no communication is provided between the same actuators.

When the vehicle enters the parabolic entry transition section of a curve, activation of the body roll control system is operated by the electronic unit 14. The thrust chambers 11*a* of the actuators 10*a* (or the chambers 11*b* of the actuators 10*b*, respectively), corresponding to the vehicle side situated towards the inside of the curve, are placed in communication with the power generator 12 while the chambers 11*b* of the actuators 10*b* (or the chambers 11*a* of the actuators 10*a*, respectively), corresponding to the vehicle side facing towards the outside of the curve, are connected to a discharge through corresponding actuation of the valve unit 13 performed by the regulation electronic unit 14 in response to the output signals of the transducers 15 and 16. Accordingly the body 1 is rotated about its longitudinal axis towards the inside of the curve, thus limiting the transverse acceleration felt by the passengers within the body. Actuation of the roll control system of the body 1 is maintained while the vehicle is running along the full curve and up to the end of the exit transition section thereof.

In the actuated condition of the body roll control system along the entry curve transition section, along full curve and along the exit transition section, mutual connection between the thrust chambers 11*a*, 11*b* of the actuators 10*a*, 10*b* corresponding to each vehicle side enables preventing phenomena of "autogenous skew" generation, and thus obtaining a high travel intrinsic safety degree of the vehicle.

Naturally the details of construction and the embodiment may be widely varied with respect to what has been disclosed and illustrated purely by way of example, without thereby departing from the scope of the present invention such as defined in the appended claims.

What is claimed is:

1. A body roll control system for a railway vehicle having a variable trim body, wherein the vehicle includes first and Second bogies having respective opposite left and right sides and resilient suspension means between said body and said bogies, said control system comprising two pairs of respectively left and right fluid pressure linear actuators interposed substantially vertically between said body and said left and, respectively, right sides of said first and second bogies, a source of fluid under pressure, valve means controlling connection between said actuators and said source of fluid under pressure through respective fluid lines, a regulation electronic unit operatively associated to said valve means, and transducer means for detecting the non-compensated centrifugal acceleration acting on said body and for transmitting corresponding output signals to said regulation electronic unit to pilot said valve means so as to perform, while the vehicle is travelling along a curve, rotations of said body about a longitudinal axis tending to compensate said centrifugal acceleration, each said left and right actuator comprising a single-acting cylinder having a single thrust chamber, the thrust chamber of each left single-acting cylinder being in communication solely with the thrust chamber of the other left single-acting cylinder and the thrust chamber of each right single-acting cylinder being in communication solely with the thrust chamber of the other right single-acting cylinder, and wherein said valve means comprise a single valve unit connected to said single thrust chambers of both said left and said right single-acting cylinders.

2.A railway vehicle having a variable trim body, first and second bogies having respective left and right sides, resilient suspension means between said body and said bogies, and a body roll control system comprising two pairs of respectively left and right fluid pressure linear actuators interposed substantially vertically between said body and said left and, respectively, right sides of said first and second bogies, a source of fluid under pressure, valve means controlling connection between said actuators and said source of fluid under pressure through respective fluid lines, a regulation electronic unit operatively associated to said valve means, and transducer means for detecting the non-compensated centrifugal acceleration acting on the body of the vehicle and for transmitting corresponding output signals to said regulation electronic unit to pilot said valve means so as to perform, while the vehicle is travelling along a curve, rotations of said body about a longitudinal axis tending to compensate said centrifugal acceleration, each said left and right actuator comprising a single-acting cylinder having a single thrust chamber, the thrust chamber of each left single-acting cylinder being in communication solely with the thrust chamber of the other left single-acting cylinder and the thrust chamber of each right single-acting cylinder being in communication solely with the thrust chamber of the other right single-acting cylinder, and wherein said valve means comprise a single valve unit connected to said single thrust chambers of both said left and said right single-acting cylinders.

* * * * *